United States Patent [19]

Gitman

[11] Patent Number: 4,718,643

[45] Date of Patent: Jan. 12, 1988

[54] METHOD AND APPARATUS FOR RAPID HIGH TEMPERATURE LADLE PREHEATING

[75] Inventor: Grigory M. Gitman, Dluth, Ga.

[73] Assignee: American Combustion, Inc., Norcross, Ga.

[21] Appl. No.: 863,862

[22] Filed: May 16, 1986

[51] Int. Cl.[4] ..... F27D 23/00

[52] U.S. Cl. ..... 266/44; 266/88; 266/155; 266/159; 266/901; 432/4; 432/37; 432/224; 432/225

[58] Field of Search ..... 266/44, 88, 156, 158, 266/159, 901, 155; 432/4, 37, 224, 225

[56] References Cited

U.S. PATENT DOCUMENTS

| | | | |
|---|---|---|---|
| 4,223,873 | 9/1980 | Battles | 266/44 |
| 4,229,211 | 10/1980 | Battles | 266/44 |
| 4,359,209 | 11/1982 | Johns | 266/44 |
| 4,364,729 | 12/1982 | Fresch | 266/44 |

*Primary Examiner*—L. Dewayne Rutledge
*Assistant Examiner*—Robert L. McDowell
*Attorney, Agent, or Firm*—Needle & Rosenberg

[57] ABSTRACT

This invention relates to ladle heating methods and apparatus. More particularly, this invention pertains to rapid high temperature ladle preheating utilizing an optimized heating cycle by involving oxygen and combustion air preheated by recuperation in the fuel burning process. Controlled oxygen flow directed into the process is used to increase the heat input during the initial preheating phase and to insure maximum efficiency of the system during the soaking phase of ladle preheating. The disclosed ladle preheating station comprises a refractory lined lid including a partially open refractory ring for docking a portion of a ladle rim having a significant protrusion caused by a local accumulation of solidified metal or slag, said refractory lid opening shaped to receive said protrusion within the opening while providing a gap between said metal deposition and the refractory lid. A burning device is located through said refractory lid for combusting fuel with air or oxygen or both and directing high temperature combustion products into the ladle interior. Also disclosed is a means for providing a protective facing for the ladle heater ring where it comes into contact with the ladle rim. The facing comprises stainless steel plates with a soft refractory material between said plates and the main refractory material of the ladle heater.

23 Claims, 4 Drawing Figures

METHOD AND APPARATUS FOR RAPID HIGH TEMPERATURE LADLE PREHEATING

BACKGROUND OF THE INVENTION

This invention relates to ladle heating methods and apparatus. More particularly, this invention pertains to rapid high temperature ladle preheating utilizing an optimized heating cycle by involving oxygen and combustion air preheated by recuperation in the fuel burning process. For the purpose of this application, the word "ladle" shall be understood to include tundishes, AOD vessels, BOF vessels, and other refractory vessels for holding molten metal.

Refractory lined ladles used in molten metal handling are normally preheated prior to use and also are kept hot during idling time when they are waiting for a metal charge. Also, ladles must be heated when drying new or repaired refractory linings.

Ladle preheating stations used for firing into the ladle interior during preheating, reheating and drying have been very inefficient because of primitive combustion controls and high energy losses. Three major components of energy loss occur during ladle heating: (1) heat is lost with the flue gases due to the high temperature required and inadequate fuel/air ratio control, (2) heat is lost due to cold air infiltration through the gap between the ladle rim and the refractory lined wall of ladle preheating stations, and (3) heat is lost by radiation from the flame, the ladle and the heater wall refractory lining through said gap between the ladle and the heater.

Some prior art patents have attempted to overcome these energy losses. For instance, techniques of heat recovery during ladle preheating by recuperation are disclosed in U.S. Pat. Nos. 1,057,905 and 4,229,211. Here, different methods of sealing of the ladle rim are applied to direct flue gases into a recuperator for preheating of combustion air. Both of these methods of sealing create inconveniences in actual operation. The method disclosed in U.S. Pat. No. 1,057,905 requires the ladle to be inverted which is an unacceptable posture for large steel mill ladles. The method of U.S. Pat. No. 4,229,211 cannot be properly utilized in many cases without clearing the rim of the ladle to remove solidified metal and slag, and the heater wall must be relined frequently due to damage to the compressible lining of the seal assembly of the heater by docking with the rough rim of the ladle.

The method disclosed in U.S. Pat. No. 4,359,209 tries to overcome these problems by arranging an air seal around entire gap between the rim of the ladle and the wall of the preheating station by discharging flue gases through said gap and then, after mixing said flue gases with ambient air outside of the ladle interior, directing this mixture into the recuperator to preheat the combustion air. The disadvantage of this method and apparatus is that in practice the dimension of said gap has to be at least equal to the thickness of local deposition of solidified metal at the ladle spout, which is typically between 4" and 12". Such a gap cannot be overcome with the amount of hot combustion gases that are typically generated by the burner in the ladle interior. Another disadvantage of this system is that radiative heat losses through the gap still occur.

It is also desirable to reduce the time for completion of the ladle heater heating cycle.

The heating of a ladle consists of two stages: (1) preheating to the desired temperature of the hot face of the lining, and (2) soaking heat into the refractory lining by keeping the hot face at the desired temperature. Initially, the heat flux introduced into the ladle refractory lining throughout its hot face is stored in the refractory material located close to the hot surface of the lining, and only a relatively small part of the heat is transferred throughout the refractory lining due to the low thermal diffusivity of the ladle refractory's lining materials. This results in a sharp reduction of the refractory's ability to accept heat as the ladle heating cycle proceeds. New advanced refractory materials such as dolomite and magnesite are used today for high quality steel products. Compared to conventional refractories, these materials require 50% more heat storage in the ladle refractory lining (about 30,000 Btu/ft$^2$) and a temperature of 2100° F. or higher for the hot face of the ladle refractory. At the same time, the significantly higher price of said refractories have forced steel makers to minimize the number of ladles they have in operation, which reduces the preheating cycle time. Therefore, increased intensity of ladle heating has become desirable in addition to increased energy recovery efficiency. The shortening of the heating cycle, together with the increase of heat storage required in the refractory lining, demands a higher heat flux from the flame to the ladle lining being heated.

Efficient energy recovery under such conditions requires a very complicated recuperator containing radiant and convective heat exchangers having impractically high turn down ratios. Such a method of heat recovery is especially inappropriate for ladle heating due to the necessity to maintain a very high pressure drop through the recuperator and, therefore, a nearly perfect seal between the rim of the ladle and the ladle heating station.

Because of this, existing recuperative ladle heaters are designed to meet the conditions of the soaking cycle. But this is when the flue gas temperature is at a maximum and the air flow is significantly reduced, so the danger of overheating the recuperator has to be addressed. Therefore, during the preheating cycle, the ability to increase the heat input from conventional ladle heating stations is limited and results in the loss of heat recovery efficiency and increases the duration of the preheating cycle.

SUMMARY OF THE INVENTION

To maximize ladle heating station productivity and efficiency, pure oxygen may be used to participate in the combustion process to overcome the limitations of existing ladle heating stations. Controlled oxygen flow directed into the process is used to increase the heat input during the initial preheating phase and to insure maximum efficiency of the system during the soaking phase of ladle preheating. Control of fuel, air and oxygen flow not only has the traditional goal of maintaining a fuel/oxidizer ratio close to stoichiometric but also has a new goal of controlling the air/oxygen ratio to optimize the reduction of the ballast nitrogen volume based on the process temperature. This helps the ladle heating system to overcome the prior art limitations on recuperation during the preheating phase and to reduce the duration of the preheating phase. Such oxygen may be introduced into the combustion process by enriching the combustion air with oxygen or separately by using the combustion system disclosed in co-pending U.S. patent application Ser. Nos. 642,141 and 755,831.

Introducing a separate stream of oxidizer, such as pure oxygen, into the combustion chamber of the burner together with additional fuel input is one way to intensify the preheating cycle by causing a rapid increase in the combustion product temperature and, consequently, in the heat flux into the ladle lining. When the hot face temperature has reached the desired level and the soaking cycle has begun, the level of oxygen participation will be reduced. In this way, the portion of the heat input supplied by preheated air from the recuperator combusting with the fuel is more stable, and any increased heat input needed for the initial stage is primarily supplied by oxygen and fuel. This allows a recuperator of optimum design for the soaking period without compromising the initial heating rate or the life of the recuperator.

The ladle preheating station comprises a refractory lined lid including a partially open refractory ring for docking a portion of a ladle rim having a significant protrusion caused by a local accumulation of solidified metal or slag, said refractory lid opening shaped to receive said protrusion within the opening while providing a gap between said metal deposition and the refractory lid. A burning device is located through said refractory lid for combusting fuel with air or oxygen or both and directing high temperature combustion products into the ladle interior. A water-cooled flue duct is preferably located at the refractory lid opening to exhaust a hot mixture composed of the combustion products from the ladle interior and the ambient air being infiltrated through said gap to eliminate further penetration of said ambient air into the hot ladle interior. A recuperator communicates with said flue duct for transferring heat from the flue gases to the combustion air, and a hot air conduit supplies preheated combustion air from the recuperator to said burner. A combustion control system is desirable for separate control and proportioning of fuel, air and oxygen flows to keep the ratio of fuel to total oxygen close to or slightly above stoichiometric.

Also disclosed is a means for providing a protective facing for the ladle heater ring where it comes into contact with the ladle rim. The facing comprises stainless steel plates with a soft refractory material between said plates and the main refractory material of the ladle heater. This protective facing is easily and inexpensively replaced when damaged, avoiding the replacement of the main refractory material.

Therefore, it is an object of this invention to provide an improved ladle heating means which accomplishes the preheating or drying of ladles more efficiently than the prior art.

It is a further object of this invention to provide a means of ladle heating which reduces the amount of time required in the heating cycle for a ladle.

These and other objects and advantages will appear from the following description with reference to the drawings.

DESCRIPTION OF THE PREFERRED EMBODIMENT

The preferred embodiment is now described with reference to the drawings, in which like numbers indicate like parts throughout the views.

Figure 1:
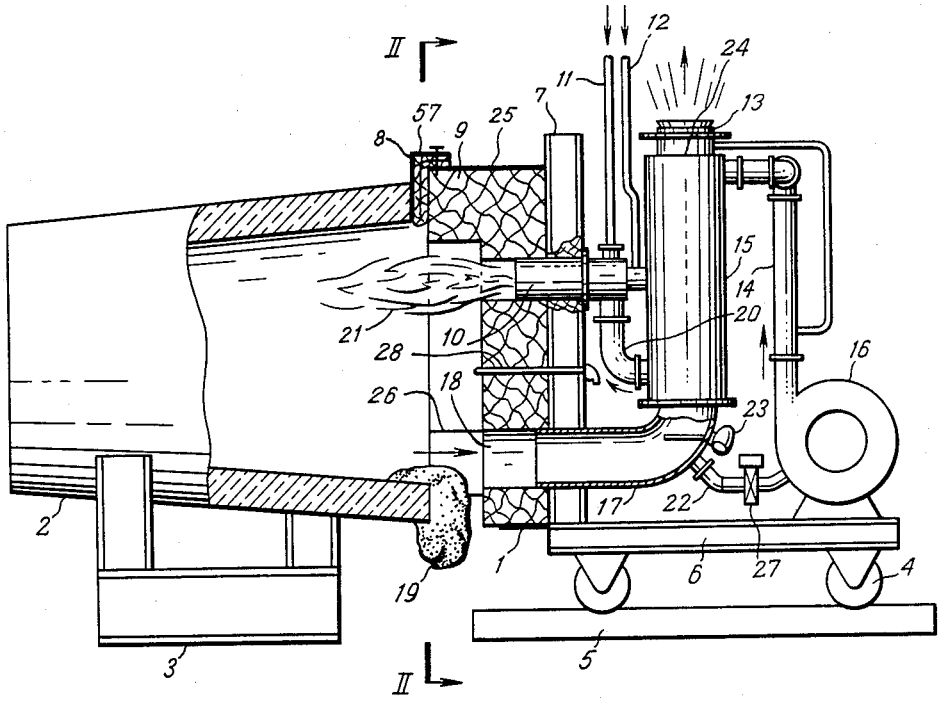
FIG. 1 is a side elevation in partial section of the ladle heater and a ladle.

FIG. 1 shows the ladle heating station 1, which utilizes hot air provided by a recuperator and a heating flame provided by a fuel/oxygen/air burner. This heating station is used to heat the metal holding ladle 2 which is positioned horizontally in a holding cradle 3. The ladle heating station is generally provided with a means of movement for docking with the ladle, such as utilizing a cart base 6 with wheels 4 movable along a short section of track 5. The cart base 6 is connected to the main wall of the ladle heater 7 which is attached to the main heater shroud 25, which is filled with refractory material 9 to help prevent heat loss. The burner 10 goes through the main wall and is directed toward the ladle to be heated. Preferably, the burner is capable of producing extremely high temperatures capable of heating ladles very quickly using a short firing cycle. The seal for the ladle lip may consist of a number of protective metalic plates which help to seal the ladle to the firing station effectively, but at the same time, make the seal quite durable. These will be described in detail below with reference to FIG. 4.

The main heater shroud 25 does not form a complete ring, but instead ends near the bottom 26, forming a space for clearance of the pour spout or ladle lip where a protrusion of slag and metal 19 will occur. Thus, a ladle being heated is sealed around most of its periphery, but remains unsealed at the lower portion defined by the shroud ends 26.

The main burner 10 for the ladle heating station has as inputs natural gas or other fuel in fuel inlet 11, pure oxygen in inlet 12 and preheated air supplied at inlet 20. The burner allows the use of high temperature combustion air while also introducing oxygen to aid in the oxidation of fuel. The burner may have a water-colled combustion chamber to enable it to provide a high temperature flame into the ladle. This arrangement facilitates very rapid heating of ladles to high temperatures which may eliminate delays in steel mill operations and help prevent excessive heat loss from the molten metal. The preheated air is provided by the air blower 16 which draws ambient air, which is supplied through a cold air supply duct 14 to the recuperator 15. The recuperator allows the burner air to receive heat from flue gas exiting the ladle, thus, directing preheated air through the hot air duct 20 to the burner 10.

The flame 21 from the burner 10 transfers heat to the lining of the ladle and the flue gases are discharged from the ladle into the exit port 18. Along with the exhaust gases withdrawn from the ladle, some ambient air is drawn into the exhaust port 18 around the lip of the ladle, which will normally have some accumulation of solidified metal or slag 19. The drawing in of ambient air creates an effective seal of the ladle 2, which prevents a chimney effect which would draw hot gases out of the ladle if the ladle were not positioned very closely to the heater. Therefore, this ladle heater design allows the handling of rough edged ladles without destroying the seal, and at the same time it allows the addition of a relatively small amount of tempering air to the exhaust stream without adversely affecting the heat exchange capabilities of the recuperator. The flue gases then enter the water cooled exhaust duct 17 where the air temperature is tempered to prevent overheating of the recuperator. Tempering takes place through the combination of water cooling and addition of cold air from the supply blower through the supply duct 22.

The draft of flue gas through the recuperator is assisted by an air ejector arrangement 24 supplied by air from the supply blower or through some other component such as an induced draft blower.

The temperature of the flue gas entering the recuperator is monitored by a thermocouple 23 and, based on the temperature, a motorized valve 27 regulates the flow of dilution air through the supply duct 22. In addition, the temperature inside the ladle is monitored by thermocouple 28, which is connected to the control system, as discussed below.

Figure 2:
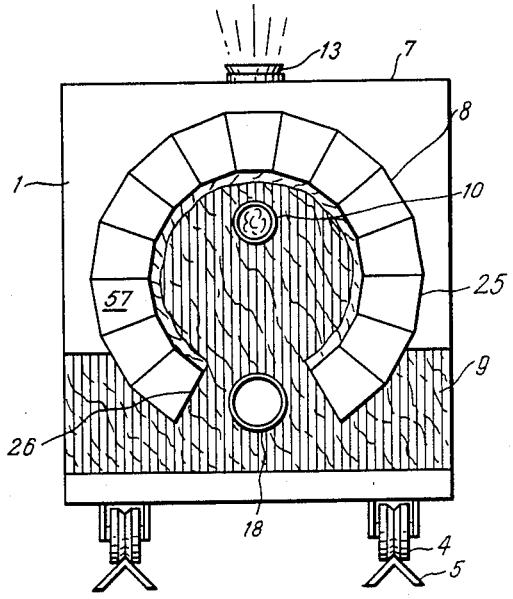
FIG. 2 is a front elevation of the ladle heater taken along line II—II of FIG. 1.

FIG. 2 depicts a front view of the ladle heating station 1 with the ladle pulled away. The seal facing 8 for the ladle lip is seen to be comprised of a plurality of plates 57. In this view the burner 10 combustion chamber is visible, as is the ladle exhaust port 18.

The refractory wall lining 9 is clearly visible, as are the ends 26 of the rim shroud 25.

Figure 3:
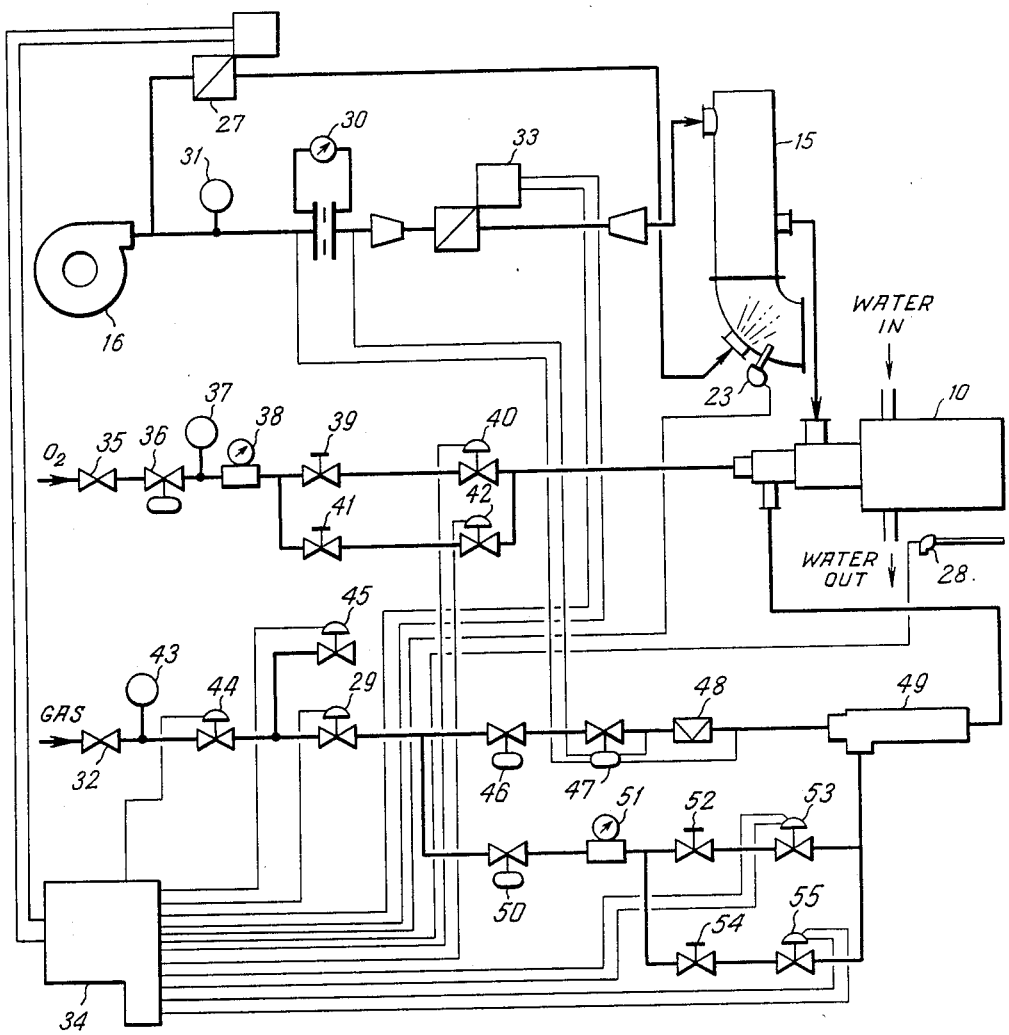
FIG. 3 is a schematic illustration of the control system for controlling the operation of the ladle heater.

FIG. 3 depicts a combustion control system for the ladle heating station. The programmable control system 34 controls the flow of fuel, air and oxygen to the burner 10 based on process data it receives on ladle temperature, principally provided by thermocouple 28 (see FIG. 1). FIG. 3 also illustrates that the burner 10 may be supplied with water to cool the combustion chamber. The air supply system comprises the air blower 16, the air pressure sensing switch 31, the air flow measuring orifice 30, the motorized air valve 33 and the recuperator 15.

The oxygen supply system comprises the manual shutoff valve 35, the main oxygen pressure regulator 36, the oxygen pressure sensing switch 37, the local oxygen flow indicator 38 and two oxygen branch lines, one containing manual adjustment flow valve 39 for providing a preset oxygen flow when solenoid valve 40 is energized to an opened position, the other branch containing manual adjustment flow valve 41 for providing another preset oxygen flow when solenoid valve 42 is energized. From these branches the oxygen then flows to the burner 10.

The natural gas supply system consists principally of the manual shutoff valve 32, the gas pressure switch 43, and the shut off, vent and blocking solenoids 44, 45 and 29, respectively. Downstream of the blocking solenoid 29 the gas branches out in two branches. The gas flow is through reducing regulator 46, and then through gas/air ratio regulator 47 which communicates with the airflow measuring orifice 30 and maintains about 1/10 ratio of gas to air throughout the entire heating cycle. Gas in this branch then flows through limiting orifice 48 and into mixing chamber 49, or may be delivered to the burner without mixing when burner 10 uses two separate gas streams.

The auxiliary branch for the gas supply passes through regulator 50, the local flow indicator 51 and into two sub-branch lines. One sub-branch contains manually adjustable flow valve 52 adjusted to provide natural gas at a ½ ratio of gas to oxygen flow in the oxygen branch containing solenoid valve 40, by simultaneously energizing solenoid valve 53 when solenoid valve 40 is energized. The other sub-branch similarly contains manually adjustable flow valve 54 and also is set to provide natural gas at a ½ ratio of the oxygen supplied through solenoid valve 42 by simultaneously energizing solenoid valves 42 and 55. Gas flowing through either of these sub-branches also enters the mixing chamber 49, or may be delivered separately to the burner.

The recuperator inlet temperature is regulated by motorized valve 27 which bleeds a portion of the air supplied by blower 16 into the recuperator flue gas inlet based on the temperature sensed by the inlet thermocouple 23.

The control system is very flexible in operation and can be configured to operate in a number of modes. Control of the proper (approximately stoichiometric) ratio between the amount of fuel and oxygen being delivered to the combustion chamber of burner 10 is accomplished by separately controlling the ratio between air supplied to the burner and the part of the gas being delivered through the branch containing regulators 46 and 47 and simultaneously controlling the ratio between the amount of auxiliary fuel flow being delivered through the branch containing regulator 50 and the flow of oxygen through the branch containing regulator 36. The controller 34 changes the level of oxygen participation in the ladle heating process and, therefore, the temperature of the flame by switching on and off the auxiliary gas and oxygen flow. Solenoids 55 and 42 are always energized simultaneously to insure the proper ratio between total gas and oxidizer flows, as are solenoids 53 and 40.

A preferred control process for preheating a ladle to 2100° F. utilizes the maximum firing rate of the system at the outset of a heating cycle. Thus, in a two auxiliary oxygen branch control system, the auxiliary branches will supply fuel and oxidizer to the burner 10 in addition to the main fuel and air supplies. This mode will be utilized until the process temperature is raised to the auxiliary set point of about 1950° F. After this point is reached, as sensed by thermocouple 28, one of the auxiliary branch gas and oxygen supplies will be closed and the controller will adjust the air flow based on the current temperature. The control system will simultaneously control the gas flow to keep the air/main gas ratio approximately stoichiometric and use at most one auxiliary branch of gas and oxygen. Of course, such a control system may be more refined by providing more than two auxiliary oxygen branches.

Figure 4:
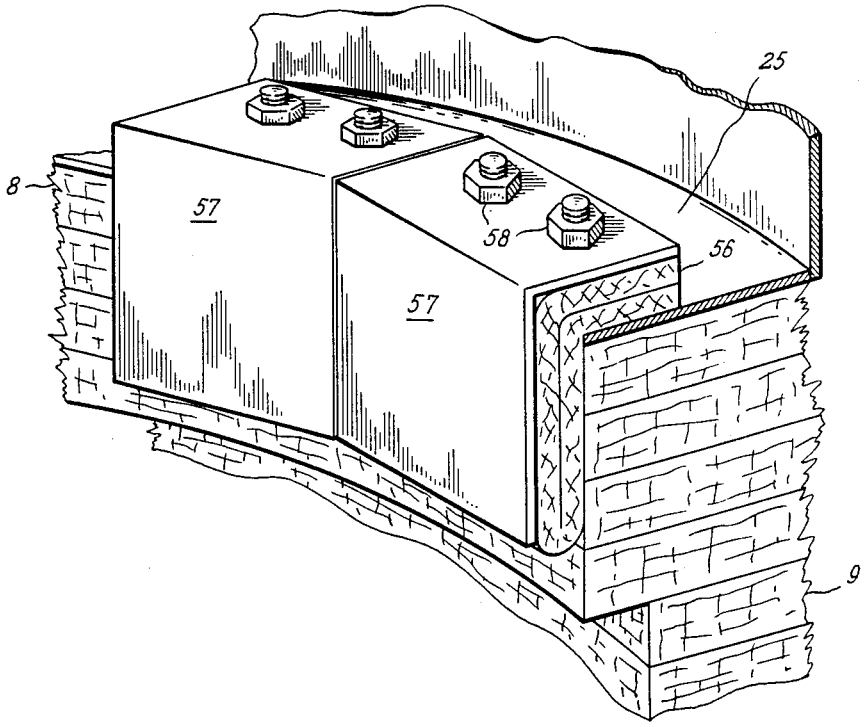
FIG. 4 is a partial cut-away view of a portion of the ladle heater ring showing the protective facing plate assembly.

FIG. 4 shows in greater detail the ladle heater ring 8 in partial section and partial cutaway view. The ceramic fiber refractory material 9 is contained circumferentially by the main heater shroud 25 and may be assembled as layers of refractory blankets or may be made of refractory brick or other refractory material. Protection for the ceramic lining of the ladle heater from damage due to contact with the ladle is provided by a folded section of ceramic fiber 56 held firmly in place by the series of protective metallic plates 57, which are preferably bolted to the periphery of the main heater shroud 25 using bolts and nuts 58. Preferably the plates 57 are made of stainless steel. The metallic plates 57 and the folded layer of soft ceramic fiber 56 are expendable and can be quickly and easily replaced when the need arises. This method of sealing will help to protect the main insulation 9 from excessive damage due to contact with the ladle. Otherwise, replacement of the main insulation would be required, which is a costly and time consuming process. Of course, this feature may be used in conjunction with ladle heaters having a variety of configurations.

While this invention has been described in detail with particular reference to the preferred embodiment thereof, it will be understood that variations and modifications can be effected within the spirit and scope of the invention as previously described and as defined in the claims.

What is claimed is:

1. An apparatus for preheating a ladle, which comprises:

a refractory lined wall;

a partial sealing ring which extends forward from said wall and which is sized to meet the rim of the ladle to form an insulating seal therewith, the ends of said sealing ring forming an opening between the rim and said wall to allow for the protrusion normally caused by metal buildup on the ladle rim, said sealing ring comprising refractory material;

a burner extending through said wall, within the circumference formed by said sealing ring, for directing a flame into the ladle interior; and an exhaust duct through said wall located at the opening formed by the ends of said sealing ring, for evacuating the flue gases from within the ladle when it is being heated and also for evacuating exterior ambient air drawn through said opening toward the interior of the ladle when it is being heated.

2. The apparatus of claim 1, which further comprises a recuperator means for receiving the evacuated hot gases from said exhaust duct to preheat combustion air prior to being introduced into said burner.

3. The apparatus of claim 1, wherein said refractory material is inflexible.

4. The apparatus of claim 1, wherein at least the outer portion of said sealing ring comprises refractory fiber blanket layers and a plurality of metallic plates which form the contact face of said ring and which cover and protect the fiber blanket layers from destruction due to contact with irregular materials deposited on the ladle rim.

5. The apparatus of claim 2, wherein said exhaust duct is water cooled.

6. The apparatus of claim 2, which further comprises two means for introducing an air stream into the flue gases at said exhaust duct to reduce the temperature of the flue gases and to draw them from the ladle interior and through said recuperator.

7. The apparatus of claim 2, which further comprises means for supplying fuel to said burner, means for supplying air to said burner; and means for controlling said fuel supply means and said air supply means to control the combustion from said burner.

8. The apparatus of claim 7, which further comprises a means for supplying oxygen to said burner, and means for controlling the supply of oxygen along with said means for controlling fuel and air supply, to control the combustion from said burner.

9. The apparatus of claim 8, wherein said burner comprises a water-cooled combustion chamber to enable it to provide a high temperature flame into the ladle.

10. An apparatus for preheating of ladles, which comprises:

a refractory lined wall including a ring portion extending forward from the base of said wall and sized to meet the rim of the ladle;

a burner extending through said wall, within the circumference formed by said ring, for directing a flame into the ladle interior;

an exhaust channel for evacuating the flue gases from within the ladle when it is being heated;

a fuel valve means for controlling the fuel flow being delivered through said burner;

air valve means for controlling the combustion air being delivered through said burner;

oxygen valve for controlling the oxygen flow being delivered through said burner;

control means for measuring the hot face ladle lining temperature and for communicating with said fuel, air and oxygen valve means to control the heat input of said burner and flame monitoring the instant flows of fuel, air and oxygen, and maintaining the ratio of fuel to total oxidizer close to stoichiometric and to adjust the ratio of air to oxygen based on said temperature.

11. The apparatus of claim 10, wherein said exhaust channel is arranged as an opening in the ring of said wall.

12. The apparatus of claim 10, which further comprises a recuperator communicating with said exhaust channel and recovering part of the waste heat contained in the flue gases by preheating the oxidizer being delivered to said burner.

13. The apparatus of claim 12, which further comprises means for measuring the temperature of said oxidizer mixture being preheated by said recuperator and means for controlling the oxygen/air ratio of said oxidizer based on said temperature.

14. The apparatus of claim 10, wherein said ring portion of said refractory wall comprises refractory fiber blanket layers and a plurality of metallic plates which protect said blanket layers from destruction due to contact with irregular material deposited on the ladle rim.

15. A method of a rapid ladle preheating comprising the steps of:

substantially enclosing and sealing the open end of a ladle with refractory material;

providing an opening in said refractory material enclosure sufficient to receive within said opening protrusions caused by material buildup on one sector of said ladle;

generating a flame and directing it into the interior of said ladle;

exhausting the combustion products of said flame through an exhaust port in said ladle heater located adjacent to said opening in said refractory material; and exhausting, with said combustion products, ambient air which infiltrates into said ladle interior through said opening.

16. The method of claim 15, which further comprises the steps of directing said combustion products through a recuperator, and preheating combustion air to be used in said flame generating step.

17. The method of claim 16, which further comprises the step of providing a controllable flow of oxygen to be use in said flame operating step to increase the flame temperature and reduce the heating cycle.

18. An apparatus for heating ladles, including burner means, a cover, and a ladle rim sealing surface comprising refractory material integral with said cover, wherein the improvement comprises:

metallic plates covering said sealing surface refractory material to protect the refractory material from contact with the ladle rim.

19. The apparatus of claim 18, which further comprises:

refractory fiber blankets located between said metallic plates and said sealing surface, for providing additional protection and cushioning to the ladle rim sealing surface.

20. The apparatus of claim 19, wherein said metallic plates and said fiber blankets are removable and replaceable for maintaining the apparatus without necessitating removal of the sealing surface refractory material.

21. The apparatus of claim 20, wherein said metallic plates are stainless steel.

22. A fuel supply and control system for supplying fuel, air and oxygen to a burner which provides the flame for a ladle heater and for adjusting the temperature of the burner flame, which comprises:

means for supplying air to said burner;

means for continuous control of said air supply means;

first means for supplying fuel to said burner in about stoichiometric proportion to air supplied by said air supply means;

at least one auxillary means for supplying oxygen to said burner, comprising a flow valve which determines the amount of oxygen which will be supplied by said oxygen supply means and a controllable solenoid valve for opening and closing said supply means;

at least one auxiliary means for supplying fuel to said burner, each of said auxiliary fuel supply means associated on a one-to-one basis with each of said auxiliary oxygen supply means, comprising a flow valve which determines the amount of fuel which will be supplied by said auxiliary file supply means and a controllable solenoid valve for opening and closing said auxiliary fuel supply means, wherein the flow valve of each auxiliary means for supplying fuel provide a fuel flow which is about stoichiometric with the oxygen flow allowed by the flow valve of the associated means for supplying oxygen; and means for controlling the solenoid valves for each associated pair of auxiliary fuel supply means and auxiliary oxygen supply means such that said solenoid valves for each such pair are either both open or both closed at the same time and that said fuel supply and control system can vary the level of oxygen participation on a stepwise basis while always keeping the ratio of fuel to oxidizer about stoichometric by opening or closing the associated pairs of auxiliary fuel and oxygen supply means.

23. The system of claim 22, wherein said flow valves of said auxiliary oxygen supply means and said auxiliary fuel supply means are preset such that the flow through said valves is fixed when their respective solenoid valves are opened.

* * * * *